US008151496B2

(12) United States Patent
Lee et al.

(10) Patent No.: US 8,151,496 B2
(45) Date of Patent: Apr. 10, 2012

(54) MULTIFUNCTIONAL ELECTRIC IRON

(75) Inventors: Chih-hwa Lee, Tainan (TW); Chien-Chih Pan, Tainan (TW)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 350 days.

(21) Appl. No.: 12/637,011

(22) Filed: Dec. 14, 2009

(65) Prior Publication Data

US 2010/0146826 A1 Jun. 17, 2010

(30) Foreign Application Priority Data

Dec. 12, 2008 (CN) ..... 2008 2 0229414 U

(51) Int. Cl.
*D06F 75/18* (2006.01)
*F22B 1/28* (2006.01)
*D06C 7/00* (2006.01)

(52) U.S. Cl. ..... 38/77.83; 38/75; 38/81; 38/88; 38/94; 68/222

(58) Field of Classification Search ..... 38/77.9, 38/81, 88, 93, 94, 97, 98; 68/222; 392/386, 392/399; 219/249
See application file for complete search history.

(56) References Cited

U.S. PATENT DOCUMENTS

| | | | | | |
|---|---|---|---|---|---|
| 2,458,530 | A | * | 1/1949 | Resnick | 69/20 |
| 3,646,317 | A | * | 2/1972 | Osrow | 392/337 |
| 3,690,024 | A | * | 9/1972 | Osrow | 38/69 |
| 4,032,747 | A | * | 6/1977 | Kunz | 219/222 |
| 6,031,969 | A | * | 2/2000 | Burr et al. | 392/404 |
| 7,155,117 | B2 | * | 12/2006 | Leung et al. | 392/404 |
| D547,067 | S | * | 7/2007 | Choi | D4/100 |
| 7,516,565 | B1 | * | 4/2009 | Tsen | 38/77.1 |

FOREIGN PATENT DOCUMENTS

| | | | |
|---|---|---|---|
| EP | 000452713 | A1 * | 10/1991 |
| JP | 402243199 | A * | 9/1990 |

* cited by examiner

*Primary Examiner* — Ismael Izaguirre
(74) *Attorney, Agent, or Firm* — Rabin & Berdo, P.C.

(57) ABSTRACT

This invention discloses a multifunctional electric iron, comprising: a steam brush and a base unit. Said steam brush can be used as a garment steamer by connecting to a power supply or a boiler, and said steam brush also can be used as an ordinary steam iron by assembling with the base unit.

9 Claims, 8 Drawing Sheets

MULTIFUNCTIONAL ELECTRIC IRON

TECHNOLOGY FIELD

The present invention relates to an electric iron, especially to a multifunctional electric iron which can be used as a steam brush or an electric iron.

BACKGROUND OF THE INVENTION

Existing ironing device has two classes: 1. iron; 2. Steam brush. The Steam Brush can output a low temperature steam for ironing, hanging ironing, but can not output high temperature steam, the use is limited. The temperature and steam of the iron can be regulated for ironing different clothings, but said iron can not be used in hanging ironing, so use is limited. As mentioned above, in order to avoid functional limitations, it must be equipped with an iron and a steam brush in the family at the same time, this leads to the result that the things positioned in the family are disorder and the purchase cost is increased, it can not meet consumer's requirement

SUMMARY OF THE INVENTION

This invention is to provide a multifunctional electric iron, which overcomes the disadvantage exist in the existing ironing device.

The present invention adopts the following technical solution:

A multifunctional electric iron comprising:

a steam brush provided with a first shell, a first steam outlet and a first electric interface;

a base unit which can be connected or disconnected to said steam brush by a connecting unit, wherein Said base unit comprising:

a second shell;

a water container disposed on the top surface of said second shell and connected with said first steam outlet when in assembly;

a second electric interface disposed on the top surface of said second shell and electrically connected with said first electric interface when in assembly;

a second steam outlet disposed on the bottom surface of said second shell;

a second chamber disposed on said second shell and connected between said water container and said second steam outlet;

a second heating plate disposed in said second shell and electrically connected with said second electric interface.

In the preferred embodiment based on present invention, said steam brush further comprising:

a first heating plate, a first chamber connected with said first steam outlet; said first electric interface and said first steam outlet disposed on the bottom surface of said first shell.

In the preferred embodiment based on the present invention, said steam brush further comprising a control unit connected to said first heating plate and said first electric interface, and a power cord electrically connected with an external power supply, said power cord electrically connected with said control unit.

In the preferred embodiment based on the present invention, said steam brush further comprising a pump electrically connected with said control unit and said first chamber.

In the preferred embodiment based on the present invention, said first heating plate and said second heating plate are parallel connection.

In the preferred embodiment based on present invention, said steam brush further comprising: a first chamber connected with said first steam outlet and a boiler connected with said first chamber; said first electric interface and said first steam outlet disposed on the bottom surface of the first shell.

In the preferred embodiment based on the present invention, said steam brush further comprising a control unit connected with said first electric interface, and a power cord electrically connected with an external power supply, said power cord electrically connected with said control unit.

In the preferred embodiment based on the present invention, said base unit further comprising a second shell, said second chamber and the second heating plate is set in the second shell, said second electric interface and the water container are set on the top surface of the second shell, said second steam outlet is set on the bottom surface of the second shell.

In the preferred embodiment based on the present invention, a connecting unit, which is locking and unlocking, formed between said base unit and said steam brush.

In the preferred embodiment based on the present invention, said first electric interface is current-conducting plate 1 provided with current-conducting bores; said second electric interface is current-conducting pole, said current-conducting pole inserts to the current-conducting bore.

In the preferred embodiment based on the present invention, a convex portion formed in the bottom surface of said first shell, said steam outlet is set in said convex portion, a concave portion formed in the top surface of the second shell, said water container is set in the concave portion; said convex portion mates said concave portion.

The technical solution as compared with the background art: in the multifunctional electric iron, the steam brush can be connected with the power supply and used as steam brush only, or can be used as an ordinary steam iron by assembling with the base unit, so it is multifunctional, and convenient for storage, and reduce the cost, and conquers the disadvantage exist in the background, and meets consumer's requirement, rapid assembly. The steam brush can be connected with the base unit by the connecting unit, so as to assure the connection and the electrical connection between the said steam brush and said base unit, the power of base unit and the power of the steam brush are in parallel connection, in order to assure separate use. The current-conducting pole and the current-conducting bore assure the stable electrical connection between base unit and the power supply. Since two heating plates are used for heating, so the high heating temperature of each heating plate is unnecessary, and reduce power consumption.

BRIEF DESCRIPTION OF THE DRAWINGS

The present invention will be further explained with the drawings and the embodiments.

Figure 1:
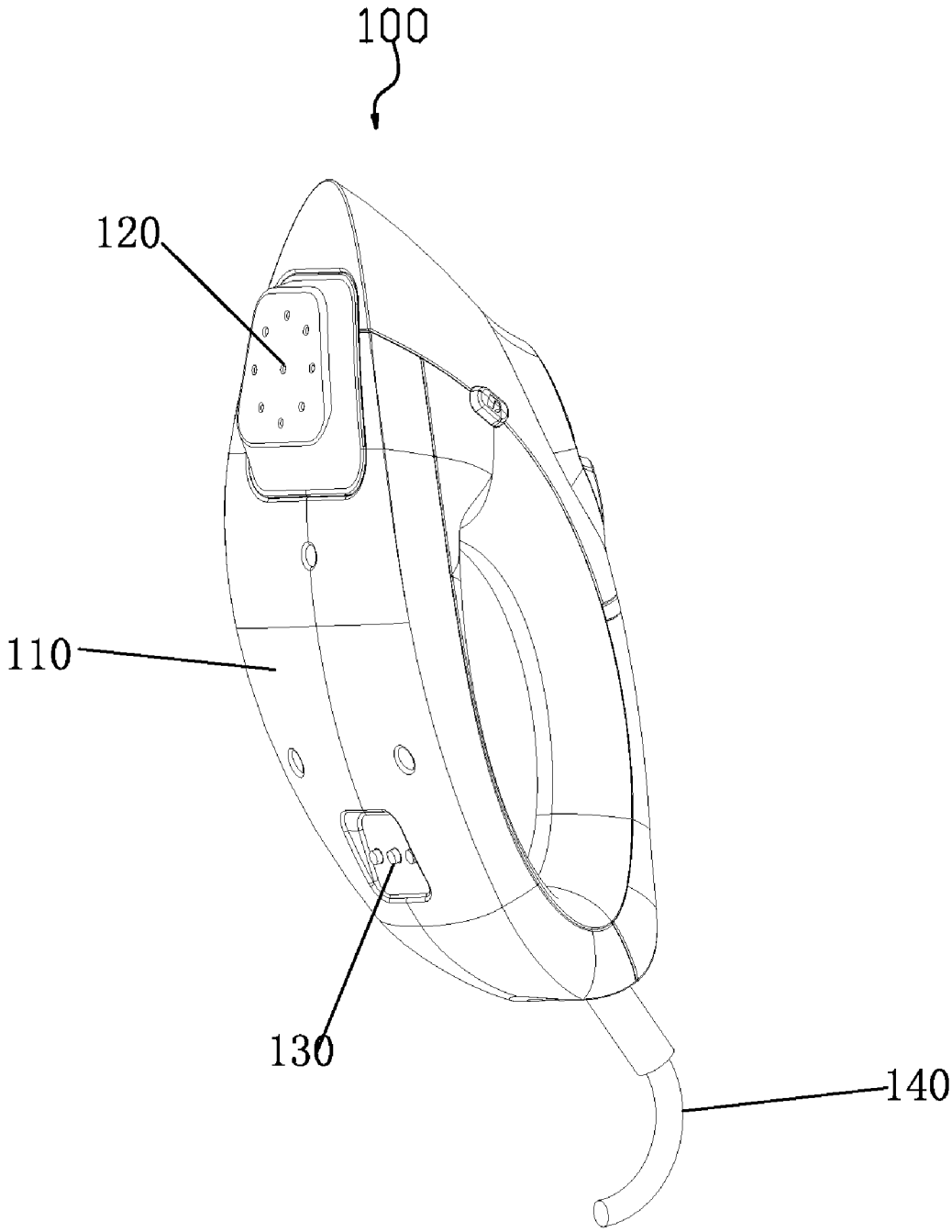
FIG. 1 is a perspective view of the steam brush of the preferred embodiment.
Figure 2:
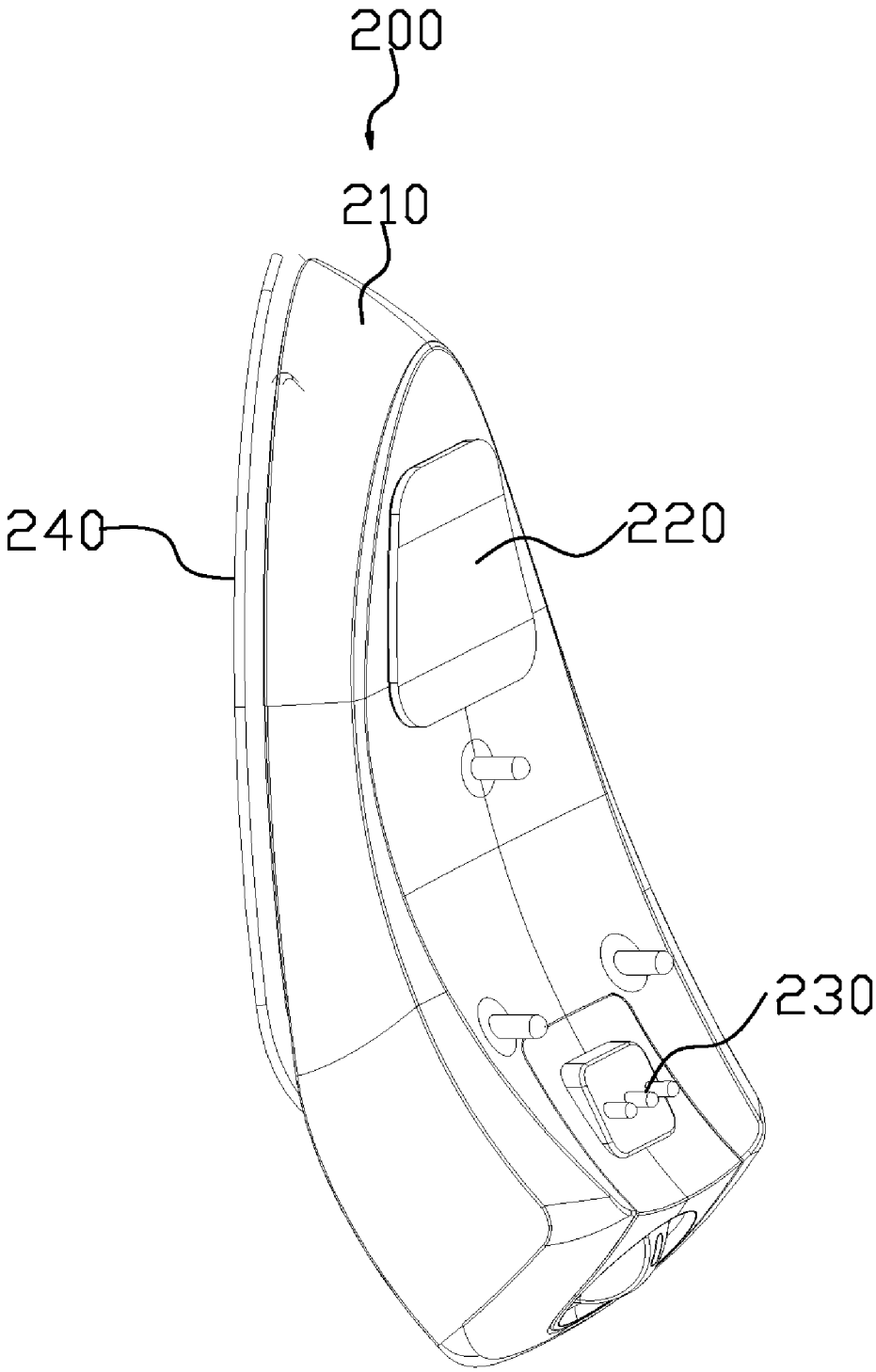
FIG. 2 is a perspective view of the base unit of the preferred embodiment.
Figure 3:
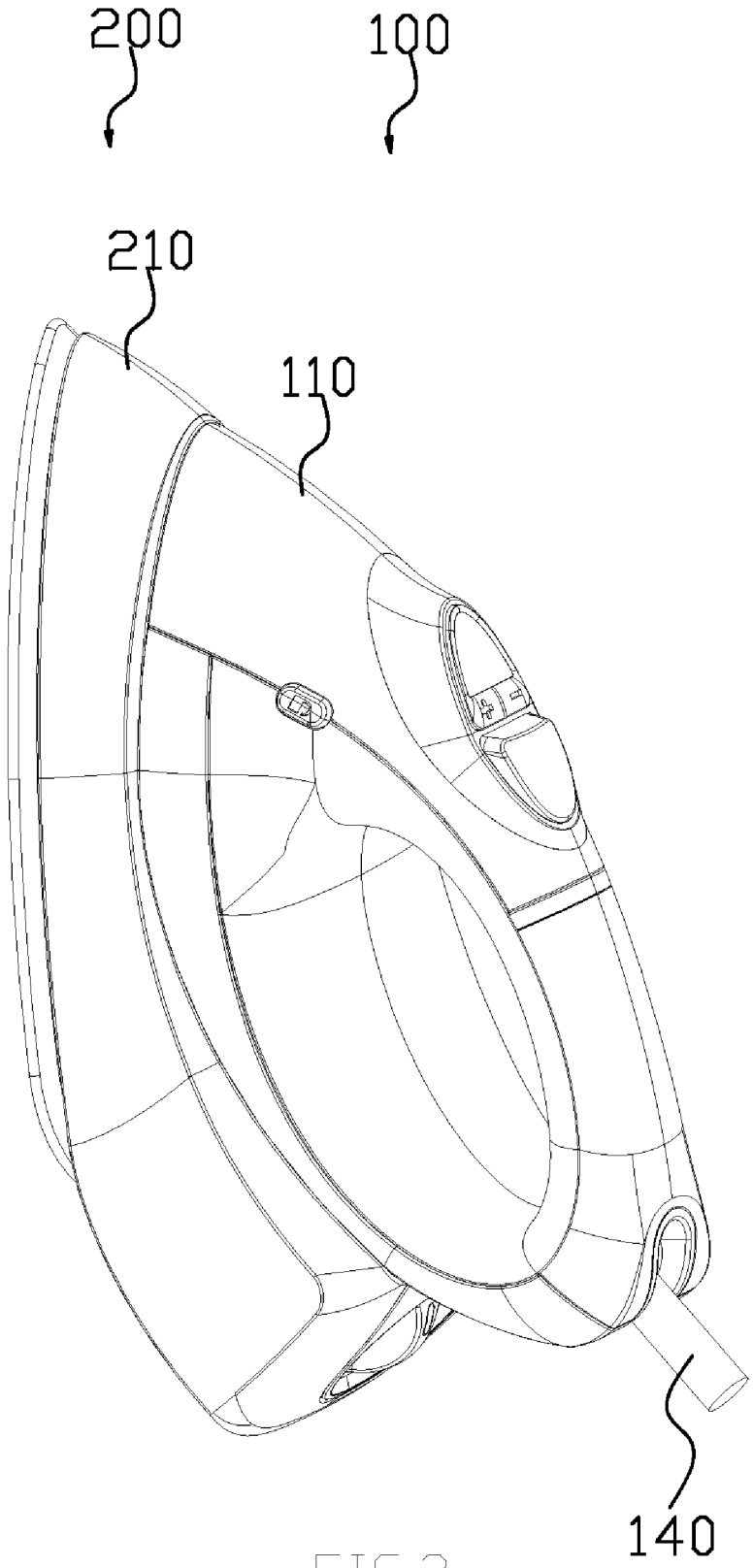
FIG. 3 is a perspective view of the electric iron of the preferred embodiment.

label declaration: steam brush 100; first shell 110; first steam outlet 120; first electric interface 130, electromagnetic pump 150; power cord 140; control unit 170, first heating plate 160, base unit 200, second shell 210, water container 220, second electric interface 230, second steam outlet 240, second heating plate 250, boiler 300, steam tube 310

DESCRIPTION OF THE PREFERRED EMBODIMENTS

Referring to FIGS. 1, 2, 3, 8, 9 a multifunctional electric iron comprising: a steam brush 100 and a base unit 200. A connecting unit 2101, which is locking and unlocking, formed between said base unit 200 and said steam brush 100.

Referring to FIGS. 1, 3, 4, 5, 8, 9 said steam brush 100 is provided with a first shell 110, a convex portion formed in the bottom surface of the first shell 110, said first steam outlet 120 is set in said convex portion, a concave portion formed in the bottom surface of the first shell 110, first electric interface 130 is set in concave portion, said first electric interface 130 is current-conducting plate, said current-conducting plate is provided with three current-conducting bores. The first chamber 180 and electromagnetic pump 150 are set in the first shell 110, said first chamber 180 is a water tube, having an inlet 181 and a outlet 182, said inlet 181 is connected with said electromagnetic pump 150 for pumping water from the water tank 190 into the first chamber 180, said outlet 182 is connected with the first steam outlet 120 for discharging steam. A handle 1101 formed on the first shell 110 for grip by user.

Said steam brush 100 further comprising a control unit 170 and a power cord 140 and a first heating plate 160. Said control unit 170 and said first heating plate 160 are set in the first shell 110, said power cord 140 is orientated and goes through said first shell 110, said power cord 140 is electrically connected with said control unit 170 (PCB), said control unit 170 can be connected with the first heating plate 160, the first electric interface 130 and the electromagnetic pump 150, the power on/off of the first heating plate 160, the first electric interface 130, electromagnetic pump are controlled by the control plate 133 positioned on the top surface of the steam brush 100, in this embodiment, we use an external power supply, the battery power supply is also can be used.

When the electromagnetic pump 150 is power on, the electromagnetic pump 150 pumps water in the first chamber 180, when the first heating plate 160 is power on, the first heating pleat heats the first chamber 180 to change the water into steam. Said steam is discharged from the first steam outlet 120.

Referring to FIGS. 2, 3, 5, 8, 9 said base unit 200 further comprising a second shell 210, a concave portion formed in the top surface of the second shell 210, a water container 220 is set in the concave portion. A convex portion formed in the top surface of the second shell 210, the second electric interface 230 is set said convex portion, in this embodiment, the second electric interface 230 is current-conducting pole. The second steam outlet 240 is set in the bottom surface of the second shell 210. a second chamber 22 is set in the second shell 210, said second chamber 22 is water tank or tube, having an inlet and a outlet, said inlet is connected with water container 220 for receiving the steam discharged from the first steam outlet 120, said outlet is connected with the second steam outlet 240 for discharging steam.

Said base unit 200 further comprising a second heating plate 250, said second heating plate is set in the second shell 210, and electrically connected with the second electric interface 230.

When the second heating plate is power on, said second heating plate heats the second chamber 22, the temperature of steam in the second chamber 22 is increased, said steam is discharged from the second steam outlet 240.

The bottom surface of the steam brush 100 mates the top surface of the base unit 200. Moreover, a connecting unit 2101, which is locking and unlocking, formed between said first shell 110 and said second shell 210, i.e. formed between said base unit 200 and said steam brush 100. Said connecting unit 2101 can be a clasp, hook, since the connecting unit 2101 is existing technology, will not be further explained.

If required, an orientation mechanism is provided between the first shell 110 and the second shell 210, said orientation mechanism can be a orientation rod 21011 and a corresponding orientation bore 11011, said orientation bore 11011 is set on one shell, and the orientation rod 21011 is set on the other shell.

Figure 4:
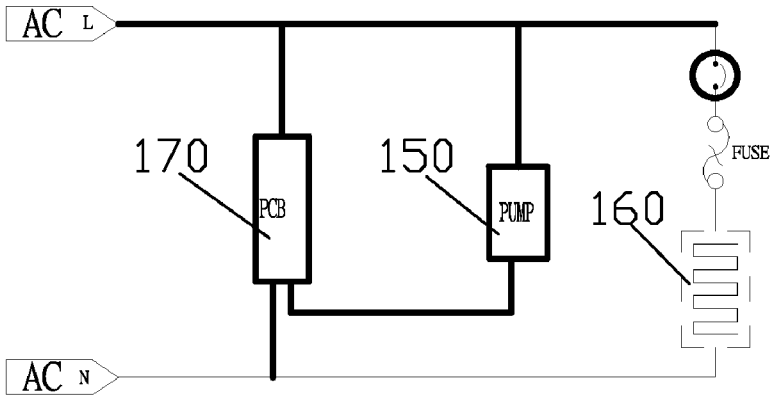
FIG. 4 is a circuit diagram of the preferred embodiment used as the steam brush only.

The steam brush 100 can be used as a garment steamer, its circuit diagram shown in FIG. 4. The first heating plate 160 of said steam brush 100 is series connection with a fuse and a control switcher. The Steam Brush can output a low temperature steam for ironing, hanging ironing, it is very convenient. The water system of said steam brush is controlled by electromagnetic pump 150, can achieve continuous steam, and the quantity of steam can be controlled. The first heating plate 160 of said steam brush has independent temperature control, can be used as a garment steamer. The steam brush is light, and easy to carry, can be used as a travel iron.

Figure 5:
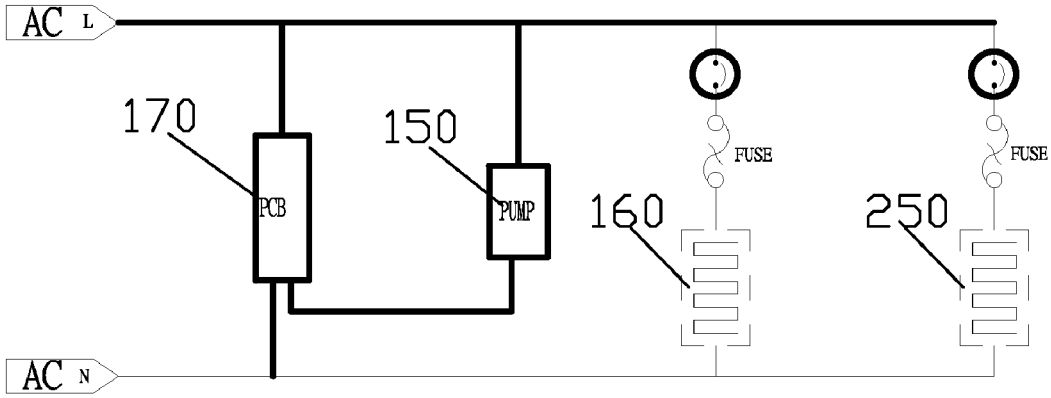
FIG. 5 is a circuit diagram of the preferred embodiment used as the electric iron only.
Figure 6:
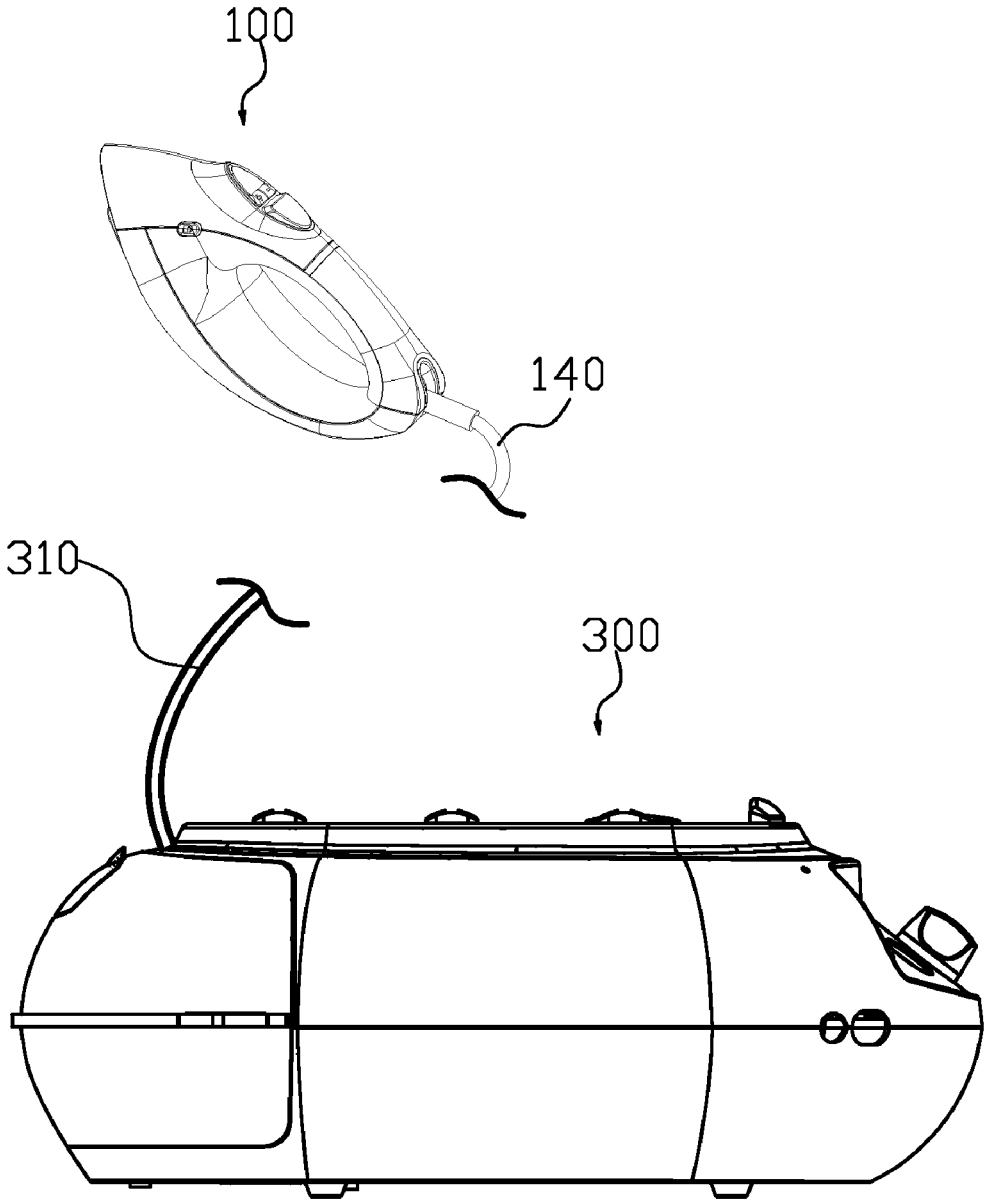
FIG. 6 is a perspective view of the steam brush of another preferred embodiment.
Figure 7:
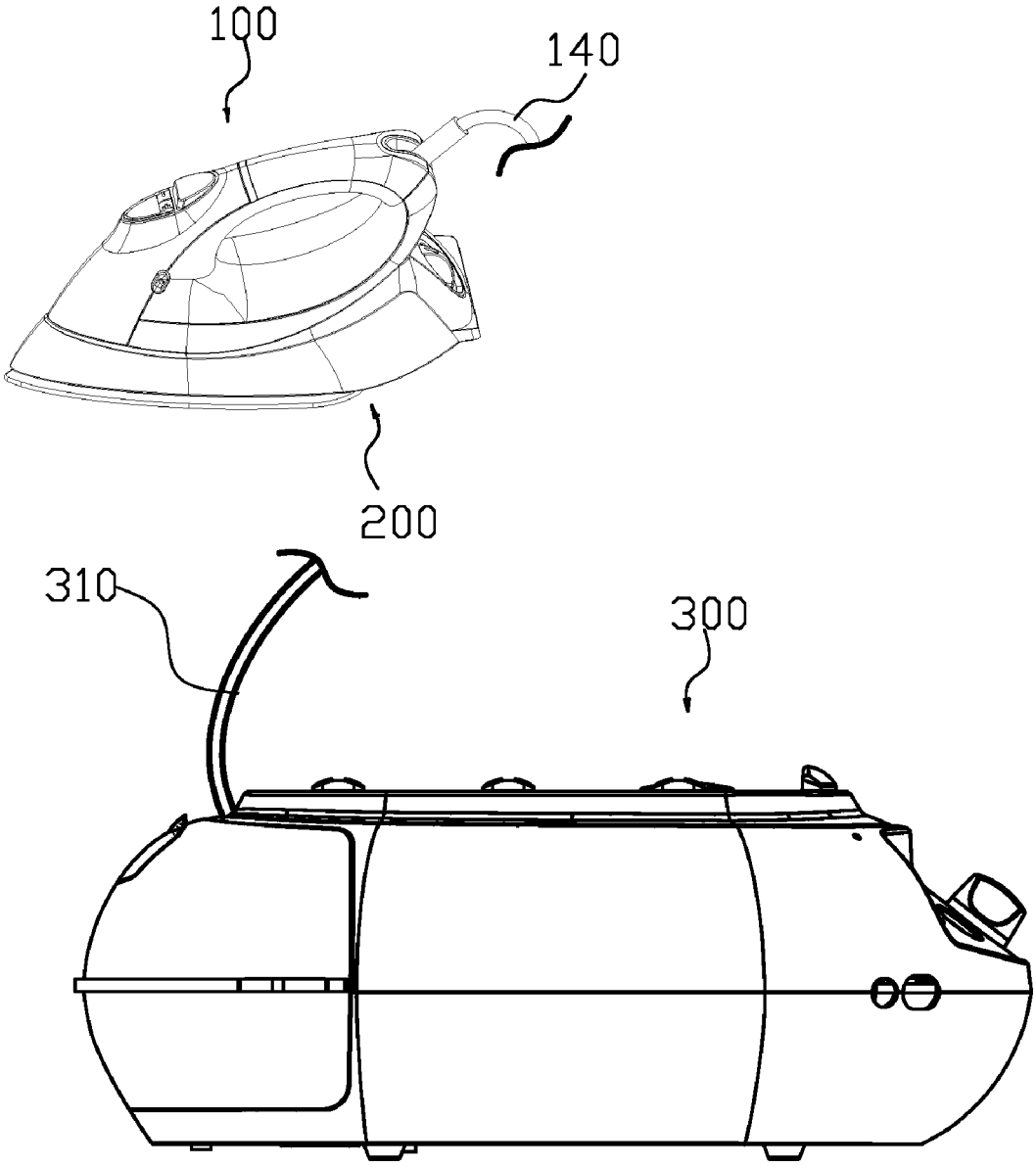
FIG. 7 is a perspective view of the electric iron of another preferred embodiment.
Figure 8:
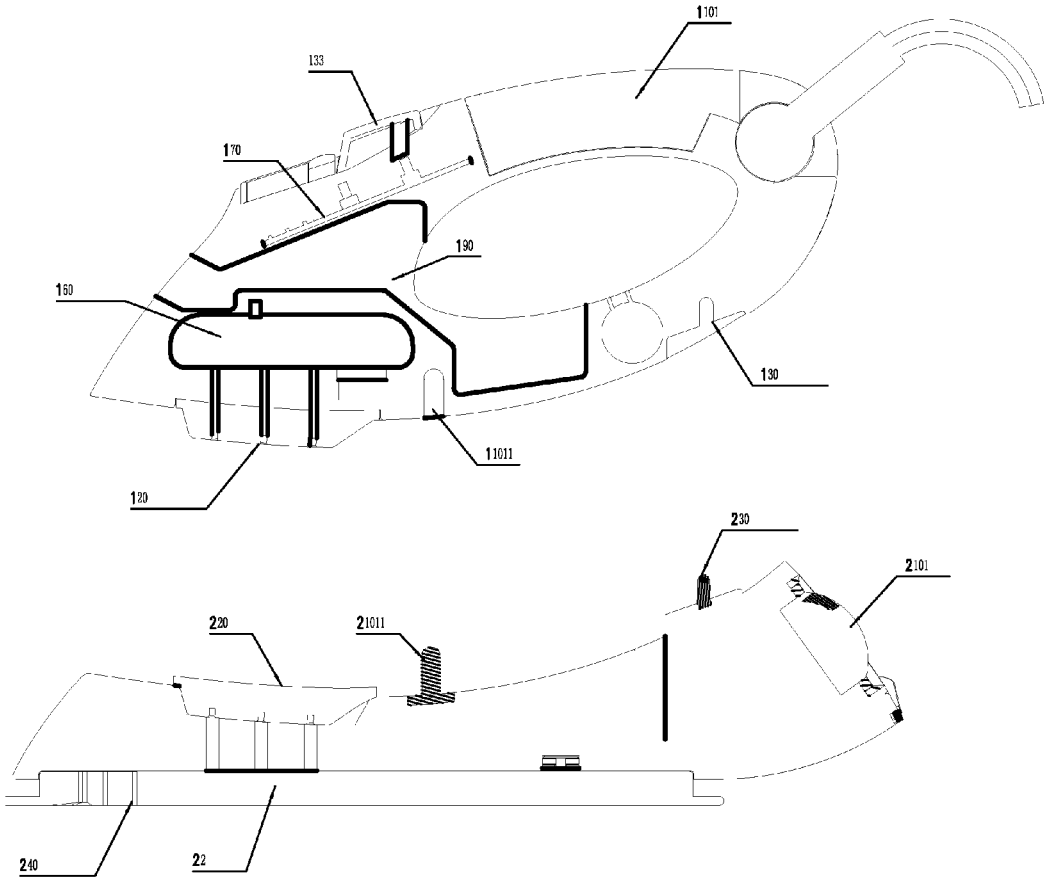
FIG. 8 is a sectional view of the steam brush and the base unit.
Figure 9:
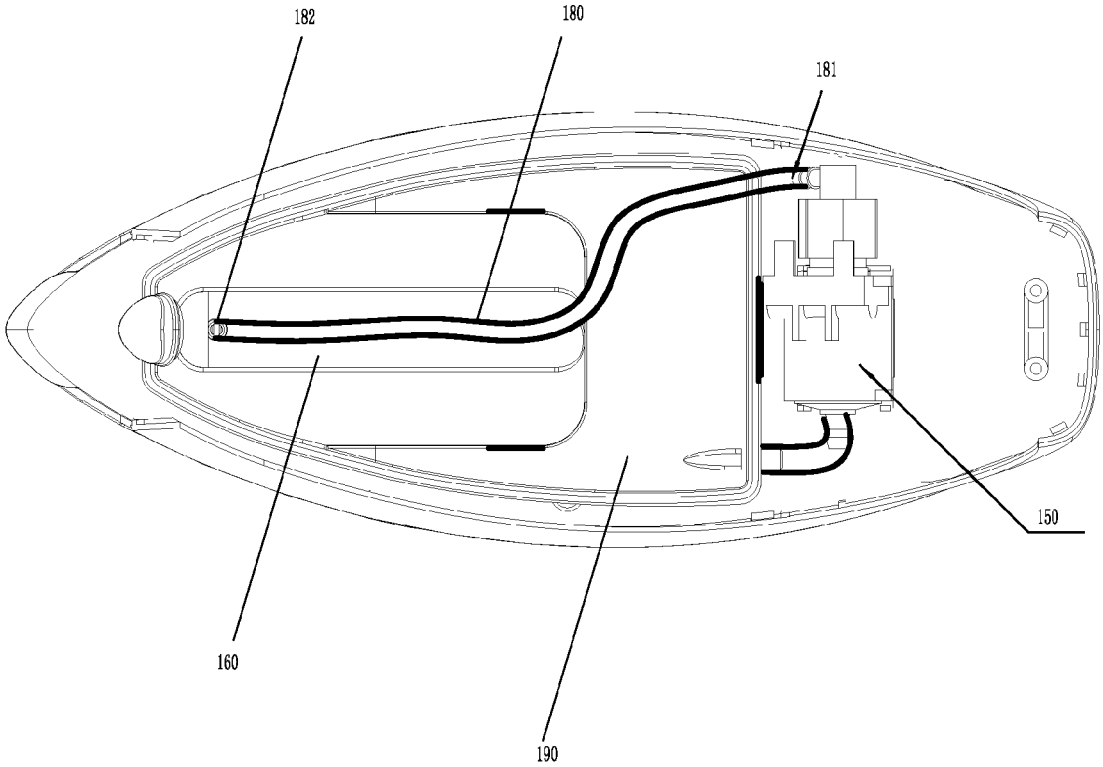
FIG. 9 is a sectional view of the steam brush.

When used as an iron, the steam brush 100 is placed above the base unit 200, said connecting unit 2101 is locking, and the concave portion mates convex portion, the first steam outlet 120 is connected with the water container 220, the steam discharged from the first steam outlet 120 goes into the second chamber 22 via the water container 220, said current-conducting pole inserts to the current-conducting bore, and the first electric interface 130 is electrically connected with the second electric interface 230, the control unit 170 provides the power for the second heating plate 250 via the first electric interface 130 and the second electric interface 230, the power on/off of the second heating plate is controlled by the power on/off of the first electric interface 130. Said second heating plate 250 heats the steam discharged from the first steam outlet 120 to form high temperature steam, and ejected from the second steam outlet 240. Referring to FIG. 5 said first heating plate 160 and said second heating plate 250 are parallel connection, said second heating plate 250 is series connection with a fuse and a control switcher, The temperature and steam of the iron can be regulated for ironing different clothings. Said first heating plate 160 and said second heating plate are two independent temperature control heaters. Water goes through the first heating plate 160, can not be completely vaporized, and then goes through the second heating plate, can be completely vaporized, to achieve the large quantity of steam via low temperature of heating plate.

The control unit 170 controls the heating temperature of the first heating plate 160 and the second heating plate via thermostat or thermistor or mechanic temperature control or electronic temperature control.

In another preferred embodiment based on the present invention, the difference compared with the above mentioned preferred embodiment: the heating plate positioned in the steam brush is removed, and connected with a boiler 300, water is vaporized via said boiler, and transported to the steam brush 100 via the team tube 310, and the steam ejected from the first steam outlet 120, and used as a steam brush with a boiler; said steam brush can be assembled with the base unit to be used as a steam iron with a boiler.

As mentioned above, the described embodiments are to be considered in all respects only as illustrative and no restrictive. All changes which come within the meaning and range of equivalency of the claims are to be embraced with their scope.

What is claimed is:

1. A multifunctional electric iron comprising:

a steam brush provided with a first shell, a first steam outlet and a first electric interface;

a base unit which can be connected or disconnected to said steam brush by a connecting unit, wherein said base unit comprising:

a second shell;

a water container disposed on the top surface of said second shell and connected with said first steam outlet when in assembly;

a second electric interface disposed on the top surface of said second shell and electrically connected with said first electric interface when in assembly;

a second steam outlet disposed on the bottom surface of said second shell;

a second chamber disposed on said second shell and connected between said water container and said second steam outlet;

a second heating plate disposed in said second shell and electrically connected with said second electric interface.

2. The multifunctional electric iron according to claim 1, wherein said steam brush further comprising: a first heating plate and a first chamber connected with said first steam outlet; said first electric interface and said first steam outlet disposed on the bottom surface of said first shell.

3. The multifunctional electric iron according to claim 2, wherein said steam brush further comprising a control unit connected to said first heating plate and said first electric interface, and a power cord electrically connected with an external power supply, said power cord electrically connected with said control unit.

4. The multifunctional electric iron according to claim 3, wherein said steam brush further comprising a pump electrically connected with said control unit and said first chamber.

5. The multifunctional electric iron according to claim 3, wherein said first heating plate and said second heating plate are parallel connection.

6. The multifunctional electric iron according to claim 1, wherein said steam brush further comprising: a first chamber connected with said first steam outlet, and a boiler connected with said first chamber; said first electric interface and said first steam outlet disposed on the bottom surface of the first shell.

7. The multifunctional electric iron according to claim 6, wherein said steam brush further comprising a control unit connected with said first electric interface, and a power cord electrically connected with an external power supply; said power cord electrically connected with said control unit.

8. The multifunctional electric iron according to claim 1, wherein said first electric interface is current-conducting plate 1 provided with current-conducting bores; said second electric interface is current-conducting pole, said current-conducting pole inserts to the current-conducting bore.

9. The multifunctional electric iron according to claim 1, wherein a convex portion formed in the bottom surface of said first shell, said steam outlet is set in said convex portion, a concave portion formed in the top surface of said second shell, said water container is set in the concave portion; said convex portion mates said concave portion.

* * * * *